US007338591B2

(12) United States Patent
Vælitalo

(10) Patent No.: US 7,338,591 B2
(45) Date of Patent: Mar. 4, 2008

(54) METHOD FOR THE CATHODIC PREVENTION OF REINFORCEMENT CORROSION ON DAMP AND WET MARINE STRUCTURES

(75) Inventor: Sten H. Vælitalo, Drammen (NO)

(73) Assignee: Protector AS, Tranby (NO)

( * ) Notice: Subject to any disclaimer, the term of this patent is extended or adjusted under 35 U.S.C. 154(b) by 140 days.

(21) Appl. No.: 10/514,205

(22) PCT Filed: May 12, 2003

(86) PCT No.: PCT/NO03/00154

§ 371 (c)(1),
(2), (4) Date: Jun. 13, 2005

(87) PCT Pub. No.: WO03/095393

PCT Pub. Date: Nov. 20, 2003

(65) Prior Publication Data

US 2005/0236279 A1 Oct. 27, 2005

(30) Foreign Application Priority Data

May 13, 2002 (NO) ..... 20022267

(51) Int. Cl.
*C23F 13/02* (2006.01)

(52) U.S. Cl. ..... 205/734

(58) Field of Classification Search ..... 205/734
See application file for complete search history.

(56) References Cited

U.S. PATENT DOCUMENTS 4,319,854 A * 3/1982 Marzocchi ..... 404/28
5,292,411 A 3/1994 Bartholomew et al.
5,750,276 A * 5/1998 Page ..... 428/703
5,968,339 A * 10/1999 Clear ..... 205/730
6,217,742 B1 4/2001 Bennett
6,855,199 B1 * 2/2005 Pruckner ..... 106/600
2002/0023848 A1 2/2002 Whitmore

FOREIGN PATENT DOCUMENTS

| | | |
|---|---|---|
| GB | 2 279 664 | 1/1995 |
| WO | WO 00/46421 | 8/2000 |
| WO | WO 02/33148 | 4/2002 |

OTHER PUBLICATIONS

Solomon, I. et al., "An Economic Solution for the Cathodic Protection of Concrete Columns Using a Conductive Tape System", Corrosion Science (1993), vol. 35, Nos. 5-8, pp. 1649-1660.

* cited by examiner

*Primary Examiner*—Bruce F. Bell
(74) *Attorney, Agent, or Firm*—Young & Thompson

(57) ABSTRACT

A method is described for preventing and comabating corrosion on semi-dry, moist and wet concrete marine structures, comprising that, against the surface of the structure to be protected on a permanent basis, there is fastened an inert, conductive material, pressed by the fastening against an intermediate contact-establishing, hydroscopic material, and where a voltage is applied on a permanent basis between the reinforcement in the concrete and the affixed inert, conductive material.

8 Claims, No Drawings

METHOD FOR THE CATHODIC PREVENTION OF REINFORCEMENT CORROSION ON DAMP AND WET MARINE STRUCTURES

BACKGROUND OF THE INVENTION

The present invention relates to a method for cathodic protection against reinforcement corrosion on semi-dry, damp and wet marine structures.

Marine structures of reinforced concrete located in salt water/seawater are particularly susceptible to corrosion. This is due to the fact that chlorides from the salt water penetrate into the concrete and cause reinforcement corrosion, and the consequent loss of load-bearing capacity. Because the structures involved are often wharves, bridges and the like, such a loss of load-bearing capacity is extremely serious. The corrosion will shorten the life time of the structure dramatically and will lead to extremely high maintenance costs.

Extensive work has gone into finding methods which can prevent corrosion in concrete in general, and also in concrete marine structures. In addition to cathodic protection, of which the present invention is an example, realkalisation and the removal of chloride have also been used. Realkalisation and chloride removal have very many features in common: the process is of limited duration, typically 2 to 6 weeks, and is terminated when the chlorides have been removed to a sufficient degree, or when the concrete is considered to be realkalised. A relatively strong current is used, as a rule several decades stronger than that used during cathodic protection. Furthermore, the whole surface must be treated as it is the concrete and not (as in the case of cathodic protection) the actual steel reinforcement that is acted upon.

When the removal of chlorides has been terminated, the surface is protected against re-penetration of chlorides, often by using a special paint or a membrane.

Unlike realkalisation and chloride removal, cathodic protection (CP) is a permanent system which, once installed, is expected to remain active for several decades. In this process, the chlorides remain in the concrete, whilst the steel reinforcement is protected against corrosion by being polarised in the permanent electric field. Since it is the steel reinforcement that is acted upon, it is not necessary to cover the whole structure in order to provide protection.

Some examples of the efforts that have been made to solve the problem on which the present invention is based are described in the following documents:

U.S. Pat. No. 5,296,120 describes a system for realkalisation or removal of chloride. This system is in the form of a sheet or mat that can be rolled up and that is used on substantially non-planar surfaces. The mat contains an electrolyte that is disposed within cellulosic fibres. One of the purposes of this electrolyte is to transport chloride ions away from the concrete. Hydroxides of alkali or alkaline earth metals are often used as alkaline component during chloride extraction and realkalisation. This system is not effective over time when used on seawater-wetted marine structures, into which new chloride ions will penetrate after treatment, partly because these exposed surfaces cannot easily be coated with chloride-impervious coatings.

The system must also cover the whole surface that is to be treated as the reservoir for receiving chloride ions must be present across the whole surface.

One system that is basically similar is described in GB-A-2279664. Realkalisation is described in this document too.

Unlike the two preceding documents, Solomon et al., *Corrosion Science* (1993), Vol. 35, No. 5-8, ss 1649-1660, describe a solution based on CP. The concrete surface is covered with an electrically conductive tape and an anode consisting of a mixed metal oxide coated titanium mesh. According to the document, this system is used on bridge piles and columns where the layers can be fastened to the surface of the column by means of, for example, strapping. In practice, this system could not be used on, for example, the underside of a wharf where attachment would be impossible. However, it is on these surfaces that the problems will often be greatest.

Traditionally, during CP with applied voltage, an anode material is disposed within the concrete. It is either inserted in a large number of slots that are cut into in the concrete body, a large number of plugs are inserted into holes drilled at a short centre distance, or a metal wire mesh is concreted by means of shotcrete to the surface of the concrete over the whole area in which protection of the reinforcement is required. Recent years have seen the development of liquid anode systems which are spread or sprayed onto the surface. A direct current is applied between the chosen anode as positive pole and the reinforcement as negative pole. A common feature of solutions of this type is that every effort must be made to place the anodes as close as possible to the corroding reinforcement, but without touching the reinforcement as this would cause a short circuit, thus destroying the protection against reinforcement corrosion in the area. The work described above is regarded as specialist work where the installation must be carefully monitored and quality assured in order to avoid negative side effects such as those mentioned above.

In general, the carrying out of repair and installation work under wharves involves substantial costs. Wharves can be put into two categories. There are wharves that stand relatively high above the water surface with good air change under the wharf. On the other hand, there are lower wharves with poor air change, which because of their proximity to the water surface are permanently damp or wet on the surface.

On a wharf of the first-mentioned type, anode installation as described thus far is the only way to protect the reinforcement against corrosive attack. The concrete has a relatively high resistance, and it is necessary to install the anode by cutting or drilling holes in the concrete as described, or to apply a liquid anode. It is less expensive to carry out this kind of work on wharves of this type than on wharves of a low type, as there is room to work under the wharf which is relatively high (often more than 2 metres above the surface of the water).

On a wharf of the last-mentioned low type, such installation is more complicated. There is insufficient space to be able to perform the work in a comfortable manner. Furthermore, the rise and fall of the tide, the weather and boat traffic will all affect the work to a considerable extent. It is a wet and darker environment, which also bears a part in making the work more difficult. The result of this is that the costs involved in the work are also extremely high.

It is previously known that it is possible to protect the parts of wet structures that are in water by placing the anode material directly in the seawater, or by using the galvanic anode (GA) (sacrificial anode) principle to protect the reinforcement through the concrete which is now wet and has a much lower resistance.

However, measurements that the applicant has made on a typical wharf show that the need for power at the bottom edge of beams and the wharf deck—where there are often large amounts of essential structural reinforcement—is so great that a GA system will not function in a satisfactory manner.

The use of CP with applied voltage between an anode in seawater and reinforcement in higher beams will result in a situation as described above if low voltages are used (as in, e.g., a GA system).

If the voltage is increased to obtain adequate protection of the higher reinforcing bars (in conventional cathodic protection, i.e., the use of impressed voltage), measurements show that the current does not reach the higher reinforcing bars, and the only result is a strong and unwanted overprotection of the reinforcement that is closer to the surface of the water.

For CP to work in a corrosion inhibiting way on the reinforcement in the exposed structure, the reinforcement must, according to conventional knowledge, be connected to the power connection and be in electric continuity with all other exposed reinforcement in the concrete body. On a wharf of the high type, all reinforcement, if not already in continuity, must be connected together before treatment starts. Such work can be very time-consuming and difficult and, as previously explained, involves virtually unpredictable, high costs.

Surprisingly, it has been found that a good CP effect is obtained on the wettest wharves even without connecting the reinforcement together in electric continuity in accordance with conventional thinking and measurements. It is assumed that this is because in such saturated structures, despite previous divergent continuity measurements, the reinforcement is nevertheless in sufficient electric continuity when the CP current circuit is activated. It is very important to have such information available before repair work is planned.

Another major problem is the damage to the concrete which is often found under wharves as a result of corrosion of the reinforcement. Traditional, previously described CP Systems will to a great extent require that the concrete surface should be repaired before strips are embedded in slots cut therefor, plugs are embedded in holes drilled therefor, or a mesh is embedded in the concrete.

From power measurements under wharves of the low type, it has been found surprisingly that exposed reinforcement is cathodically protected without being embedded in concrete. This is because the chloride-filled corrosion products that are on the surface of the steel reinforcement have been found to have sufficient electrolytic conductivity to enable the current to reach the steel reinforcement.

There is therefore a need for a method which in a simple and cost-efficient manner facilitates the protection of wharves. On the basis of new knowledge as described above, and an awareness of the said details, important data can, for example, be gathered from the structure in a test project. The data can be used to describe an adapted CP method for repair of the wharf in question, where specialist work is avoided and replaced by work that can be carried out by persons who do not have specialist skills, but where standard power requirements for CP of the reinforcement form the basis for the end result.

SUMMARY OF THE INVENTION

The present invention is a CP system which has the focus described above and so allows good cost efficiency to be obtained.

Accordingly, the present invention provides a method for preventing corrosion on both damp and wet marine structures, but also on semi-damp and higher structures wherein, against the surface of the structure to be protected, an inert, electrically conductive material is pressed against an intermediate contact-establishing material, and a voltage is impressed, on a permanent basis, between the reinforcement in the concrete and the affixed inert, electrically conductive material.

As inert conductive material, it would be advantageous to use metal strips, for example, titanium strips coated with mixed metal oxide. As contact-establishing material, it is preferable to use a moisture-absorbing flexible, chlorine-, acid- and seawater-resistant hydroscopic material.

Unlike the prior art, which requires extensive chipping, repair, cutting and the embedding of conductive strips, plugs or mesh in the concrete, or the time-consuming installation of other anodes, the method according to the present invention is a far simpler and cheaper solution.

In the method according to the invention, the contact-establishing material on wharves will be wetted by seawater at high tide and when there is sea spray, which thus brings about an excellent electric contact between the anode and the underlying concrete. Surprisingly, it has been found that this good contact is maintained over time, which means that the method functions just as well regardless of the level of the water. The degree of moisture in the environment below the wharf seems to be the crucial factor.

According to a further development of the present invention, the aforementioned method can also be used on a wharf of the said high type by endowing the contact-establishing material with strong and endurable moisture-absorbing properties through impregnation. Furthermore, the same is achieved by ensuring in a suitable manner that the environment immediately below the wharf is changed to become more humid and wetter. Thus, also this type of wharf can be protected at a much lower price than conventionally possible. This can be achieved, for example, by using the seawater in which the wharf stands to wet the underside of the wharf, either by preventing air change and draughts under the wharf by building a permanent structure on its sides, by using water-absorbing wicks running from the sea to the anode, or by spraying the wharf from the underside with seawater using a watering system. In each case, it will be possible to use the nearby seawater in a simple manner to wet the underside and anode areas of the wharf.

DESCRIPTION OF THE PREFERRED EMBODIMENTS

Some possible embodiments of the invention will be described below.

When carrying out the invention, standard perforated titanium strips (Ti strips), coated with mixed metal oxide, can be used.

In the present invention, this strip is not inserted into slots cut into the concrete or embedded in the concrete, but is instead pressed against the concrete body from the outside, against a contact-establishing, moisture-absorbent material, for example, a chlorine-resistant or acid-resistant layer of rock wool or glass wadding, polymer felt, carbon felt or the like.

As substances for maintaining a high level of moisture in the moisture-absorbent contact-establishing material, it has been found that hygroscopic salts such as lithium nitrate or lithium bromide and the like are very effective. It is also possible to impregnate the contact-establishing material with hygroscopic inorganic gels such as silica gel or some types of zeolite.

Hygroscopic oxidation-stable organic gels can also be used.

The moisture-absorbent material is wetted in salt water and remains wet after installation in this environment. The Ti strip can be arranged in a sandwich with absorbent material, such as impregnated foam or rock wool, on both the outer and inner side, and is pressed against the concrete, for example, by stapling or screwing a impregnated wooden batten (cassette) on the outside of the strip. Advantageously, the battens may be prefabricated in lengths that are suitable for the structure in question. Alternatively, a titanium mesh can be placed on prefabricated water-proof sheets of veneer, and then overlaid with for, example, rock wool, and thus be ready to be screwed onto the concrete that the cassette is to protect. The work does not call for any special skills, and the prefabricated cassettes can be equipped with corrosion-proof sockets that are ready for later connection.

A cassette having a cross-section of 20×100 mm can be made in lengths of, for example, 3 metres, where the strip is fastened in the centre of the broad side, and where the screw fasteners pass through the cassette and into the concrete on both sides of the Ti strip. For the protection of a beam, for example, a lath is placed on either side of the lower edge of the beam. For the protection of a deck section, previously described sheets or cassettes can be wetted and fastened to the underside of the wharf deck. The titanium strips are connected together to create an anode field which later will be polarised against reinforcement. The installation is logged, the power measured and adjustments made if required. Because the cassettes in the present installation are easily accessible and visible, it will be possible at all times to evaluate the need for and to carry out maintenance of the installation.

In the conventional embedding of titanium strips and the like in wharves of the low type, apart from a system requirement that damage to concrete on the concrete surface must be repaired before the anode is installed, i.e., a substantial task (previously described), there will also be a very difficult working situation, the work being carried out from a float, boat or the like and with low working height and often a moving base, in other words, poor conditions with regard to HSE (health, safety and the environment). Naturally, this will lead to high labour costs during the work and a high final cost, and hence poor cost efficiency. The advantage obtained by this conventional work method is that the embedded strip is a part of the structure and cannot be knocked or worn off by ice or other floating objects under the wharf. The disadvantage is that the work requires a great degree of expertise and that the costs are often difficult to predict because of the complexity of the installation. In the event of a failure in the anode system of such a structure, e.g., because of a short circuit or neglect, costly new installations are often the only solution.

The method according to the invention provides a simpler and cheaper solution, primarily because the high installation costs can be eliminated, but also because it is not a system requirement that repairs should be carried out at all. As mentioned above, most of the installation work could also be carried out by persons who have no specialist skills, e.g., ordinary workmen who are close to the location of the object.

Since wharves are structures that are often located far from cities, it is obvious that this improved resource utilisation could lead to substantial savings. The part of the installation requiring special skills is, for example, design, testing, connection of cassettes and the installation of the CP voltage system and, where relevant, remote monitoring. Furthermore, an improvement of HSE standards is obtained. Another advantage is that a visual control of the anode material is made possible, for example, on a yearly basis, and damage that is visually identifiable on a lath or sheet could easily be repaired.

As previously mentioned, tests carried out by the applicant have shown that with the method according to the invention it may be unnecessary to bring the steel reinforcement into electric continuity, i.e., connect it together. It has been established that if the concrete is sufficiently wet and its resistance is thus low, electric continuity of the reinforcement is not a requirement if the anodes are placed in geometrically optimal positions. The said "movable" anode type permits the testing of optimal positioning before the main installation is started up. Naturally, in such a method there is a potential for a considerable saving, which further enhances the financial benefit obtained by the method according to the invention.

During the testing of the present invention it has also been found that it may be unnecessary from a corrosion prevention point of view to carry out repairs of a corroded structure. The reason for this is that corroded steel reinforcement which is located in a moist environment, such as under a wharf of the low type, is protected even if the steel is exposed and not embedded. The moist corrosion products have been found to have sufficient electrolytic conductivity to enable the protecting current from the CP system to reach the steel. Naturally, this presupposes that the structure is not damaged to such an extent that statically it cannot withstand the stresses to which it is exposed. If in some cases the steel does not have rust products on the surface, repair can nevertheless be avoided by pressing anodically polarised and moist contact-establishing material, for example, rock wool or glass wadding, against the exposed steel.

Consequently, the method according to the present invention makes it possible for severely corroded wharfes to have an increased life time at a reasonable price, that the wharf is preserved and, if necessary, repaired instead of being demolished and rebuilt. This means a considerable saving for the owner and for the environment and an improvement of HSE standards.

The following example is intended to further illustrate the invention.

EXAMPLE

The method according to the invention has been tested on a wharf of the low type. This wharf is located in Central Norway. The distance between the surface of the sea and the bottom edge of the wharf is 1.7 metres, and to the lower edge of the beam the distance is about 0.8 metres.

Mixed metal oxide coated titanium strips were used as conductive strips, and wetted glass wadding was used as flexible chlorine- and acid-resistant material. The titanium strips and glass wadding were premounted on impregnated cassettes (wooden laths). The wooden battens were wetted in saltwater and screwed to the concrete surface with steel bolts alternately drilled through the upper and lower part of the cassette at intervals of about 1 metre.

Sensors were mounted to measure the power on the individual reinforcing bars.

The results were as follows:

After the glass wadding had been soaked for a period of about 1 week, relatively high currents ran from the anode system into the concrete structure, so that the protection criteria according to present standards were easily reached.

The steel reinforcement with corrosion products on its surface which was exposed polarised as efficiently as the embedded reinforcement.

Typical stable current densities were measured to be about 40-50 mA per running metre of cassette.

The ratio between the price for protection based on laths or cassettes and the price of an installation of the conventional type was found to be about 1:3 to 1:4. The result, that is to say the corrosion prevention, is at least as good when the present method is used as when anodes and systems of the conventional type are installed.

The invention claimed is:

1. A method for cathodic protection against reinforcement corrosion on semi-dry, damp and wet concrete marine structures, comprising that, against the surface of the structure to be protected, an inert, electrically conductive anode material is pressed against a layer of an intermediate, moisture-adsorbent and contact-establishing material, which optionally is impregnated, and that a voltage is impressed on a permanent basis on the reinforcement in the concrete and the affixed inert conductive anode material, wherein the structure and the moisture-absorbent contact-establishing material are maintained in a moist or wet state because of the nearby seawater.

2. The method according to claim 1, wherein a layer of a flexible, absorbent chlorine-, acid-and seawater-resistant material is used as the contact-establishing material.

3. The method according to claim 2, wherein perforated rubber, foamed rubber, glass wool, rock wool, porous synthetic materials or similar organic or inorganic fiber materials are used as the layer of flexible chlorine-, acid-and seawater-resistant material.

4. The method according to claim 1, wherein hygroscopic salts are used as hydrophilic impregnation of the contact-establishing material.

5. The method according to claim 1, wherein inorganic gels are used as hydrophilic impregnation of contact-establishing material.

6. The method according to claim 1, wherein chemical and oxidation-stable organic gels are used as hydrophilic impregnation of contact-establishing material.

7. The method according to claim 1, wherein the metal strip is a strip of MMO-coated titanium metal coated with mixed metal oxides or copper-cored titanium, coated with platinum.

8. The method according to claim 7, wherein the inert conductive material is a fiber strip saturated with electrically conductive paint, in which there is placed one or more conductors in the form of carbon strips.

* * * * *